US009095493B2

(12) United States Patent
Ton

(10) Patent No.: US 9,095,493 B2
(45) Date of Patent: Aug. 4, 2015

(54) APPARATUS HAVING A FLUID DRAINAGE SYSTEM

(76) Inventor: Quy That Ton, Baton Rouge, LA (US)

( * ) Notice: Subject to any disclaimer, the term of this patent is extended or adjusted under 35 U.S.C. 154(b) by 964 days.

(21) Appl. No.: 12/837,887

(22) Filed: Jul. 16, 2010

(65) Prior Publication Data

US 2011/0010839 A1 Jan. 20, 2011

Related U.S. Application Data

(60) Provisional application No. 61/226,338, filed on Jul. 17, 2009.

(51) Int. Cl.

| | |
|---|---|
| ***A47K 3/022*** | (2006.01) |
| ***A61H 35/00*** | (2006.01) |
| ***E03C 1/23*** | (2006.01) |
| *A45D 29/00* | (2006.01) |
| *A61H 33/00* | (2006.01) |

(52) U.S. Cl.

CPC ..... *A61H 35/006* (2013.01); *E03C 1/2304* (2013.01); *A45D 29/00* (2013.01); *A61H 2033/0033* (2013.01)

(58) Field of Classification Search

CPC ..... A61H 33/00; A61H 35/006
USPC ..... 4/622, 488, 538, 671, 679, 650, 553
See application file for complete search history.

(56) References Cited

U.S. PATENT DOCUMENTS

| | | | | |
|---|---|---|---|---|
| 4,371,995 | A * | 2/1983 | Donhauser | 4/538 |
| 5,561,871 | A * | 10/1996 | Laughton | 4/619 |
| 7,490,374 | B2 * | 2/2009 | Fugate et al. | 4/622 |
| 8,296,874 | B2 * | 10/2012 | Galati et al. | 4/622 |
| 8,336,131 | B2 * | 12/2012 | Ball et al. | 4/683 |
| 2005/0204466 | A1 * | 9/2005 | Luong | 4/622 |
| 2007/0050906 | A1 * | 3/2007 | Cohen et al. | 4/622 |
| 2009/0100590 | A1 * | 4/2009 | Galati et al. | 4/541.2 |
| 2009/0288248 | A1 * | 11/2009 | Longman | 4/556 |
| 2011/0000014 | A1 * | 1/2011 | Ball et al. | 4/679 |
| 2013/0031719 | A1 * | 2/2013 | Ritchel | 4/650 |
| 2013/0042407 | A1 * | 2/2013 | Marotz et al. | 4/679 |
| 2013/0061390 | A1 * | 3/2013 | Galati et al. | 4/622 |

* cited by examiner

*Primary Examiner* — Lori Baker
(74) *Attorney, Agent, or Firm* — Minh N. Nguyen; Next IP Law Group LLP

(57) ABSTRACT

A representative spa apparatus includes a basin having a drainage opening. The drainage opening is located at the lowest point of the basin so that water can be drained. The spa apparatus further includes a basin structure that houses the basin, a chair that is attached to the basin structure and a fluid drainage system that includes a drainage element and an external control element. The drainage element is coupled to the drainage opening and the external control element controls the drainage element to open and shut the drainage opening. The external control element is attached to the basin structure remote from the basin.

19 Claims, 4 Drawing Sheets

APPARATUS HAVING A FLUID DRAINAGE SYSTEM

CROSS REFERENCE TO RELATED APPLICATIONS

This application claims the benefit of U.S. provisional application entitled, "A Spa Apparatus Having a Fluid Overflow System With an External Control Member," having Ser. No. 61/226,338, filed on Jul. 17, 2009, which is entirely incorporated herein by reference.

TECHNICAL FIELD

The present disclosure is generally related to spa apparatus and, more particularly, is related to a spa apparatus having a fluid overflow drainage system.

BACKGROUND

The pedicure industry is expanding in today's economy. A pedicure spa is located in many pedicure salons and many salon professionals are now trained to administer a pedicure to their various clients. Clients sit at the pedicure spa where technicians can provide pedicure services as well as other spa services. Salon professionals or pedicurists render treatment and comfort of the feet of a person in addition to other included services.

SUMMARY

A representative spa apparatus includes a basin having a drainage opening. The drainage opening is located at the lowest point of the basin so that water can be drained. The spa apparatus further includes a basin structure that houses the basin, a chair that is attached to the basin structure and a fluid drainage system that includes a drainage element and an external control element. The drainage element is coupled to the drainage opening and the external control element controls the drainage element to open and shut the drainage opening. The external control element is attached to the basin structure remote from the basin.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Exemplary systems are first discussed with reference to the figures. Although these systems are described in detail, they are provided for purposes of illustration only and various modifications are feasible. After the exemplary systems are described, examples of the fluid overflow system with an external control member are provided.

Figure 1:
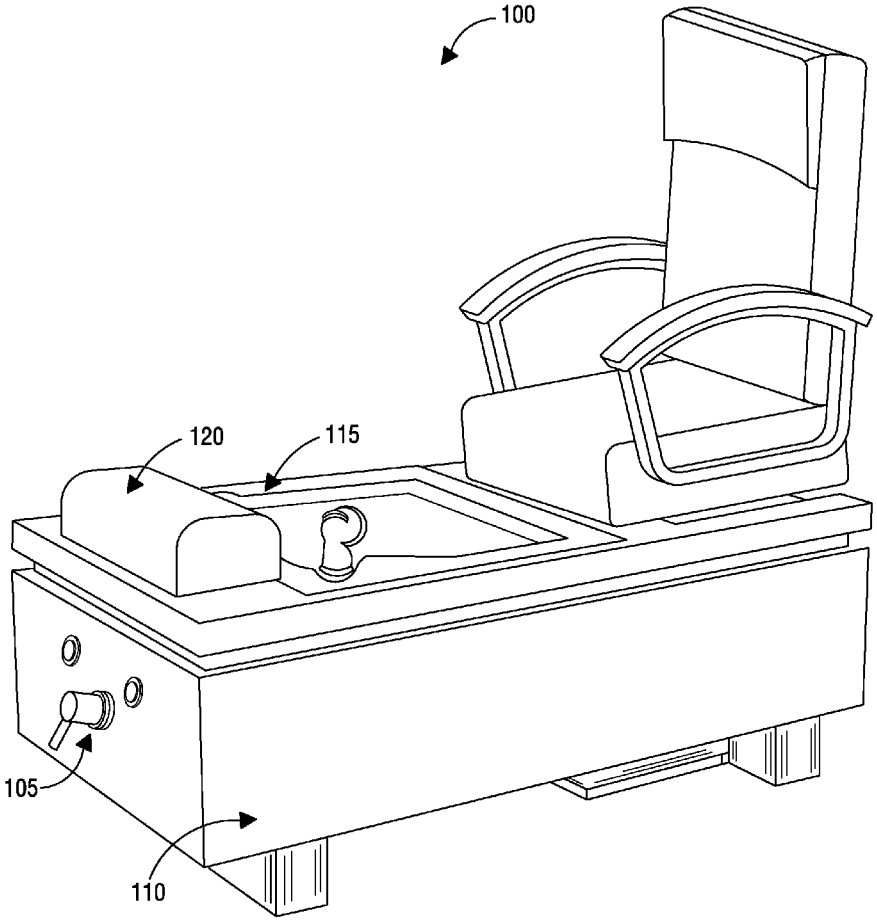
FIG. 1 is a perspective view of a spa apparatus having a fluid overflow system with an external control member according to one embodiment of the disclosure.

FIG. 1 is a perspective view of a spa apparatus 100 having a fluid overflow drainage system 300 (FIG. 3) with an external control member 105 according to one embodiment of the disclosure. The spa apparatus 100 includes a base structure 110 that contains a basin 115 and supports a chair or message chair (not shown). The base structure 110 can further include a footrest 120 in front of the base structure 110 such that the basin 115 is positioned between the footrest 120 and the chair. The external control member 105 of the fluid overflow drainage system 300 is attached to, for example, the base structure 110 or any other components of the spa apparatus 100 remote from the basin 115. The fluid overflow drainage system 300 (FIG. 3) is further described in relation to FIGS. 2-5.

Figure 2:
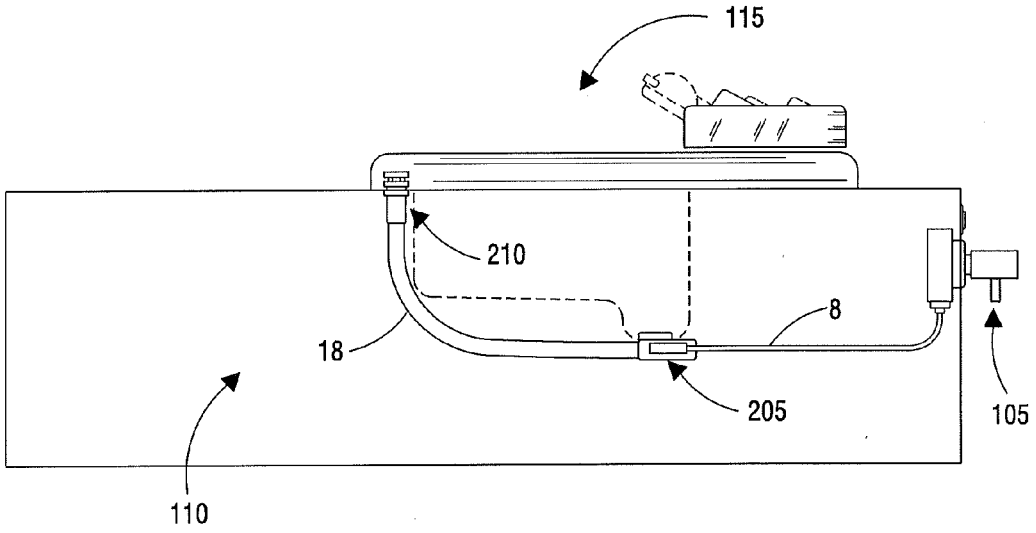
FIG. 2 is a side view of an embodiment of a spa apparatus having a fluid overflow system with an external control member, such as that shown in FIG. 1.

FIG. 2 is a side cross-sectional view of a spa apparatus 100 having a fluid overflow drainage system 300 with an external control member 105, such as that shown in FIG. 1. The base structure 110 contains a basin 115 having a drainage opening and an overflow opening. The drainage opening is fitted with a drainage element 205 that facilitates draining the fluid within the basin 115. The drainage element 205 can be fitted with a stopper 14 (FIG. 3) that can plug the drainage opening to prevent drainage of fluid, filling the basin 115 with water. The drainage opening is generally located at the lowest point of the basin 115.

The overflow opening is placed adjacent to the top of the inner surface of the basin 115 such that fluid can flow into the overflow opening as the fluid reaches the top of the basin 115. The locations of the overflow opening are further described in connection with FIGS. 4 and 5. In general, the overflow opening is fitted with an overflow element 210. The overflow element 210 covers the overflow opening of the basin 115. The overflow element 210 is coupled to a flexible tube 215 that extends and is coupled to the drainage element 205. The base structure 110 is attached to the external control member 105 at, for example, in front of the base structure 110.

The external control member 105 is mechanically coupled to the drainage element 205 via, for example, a cable 8, and controls a stopper 14 (FIG. 3) of the drainage element 205 to open and close the drainage opening. It should be noted that the external control member 105 is physically separate from the basin 115 and is attached to any exterior surface of the base structure 110.

Figure 3:
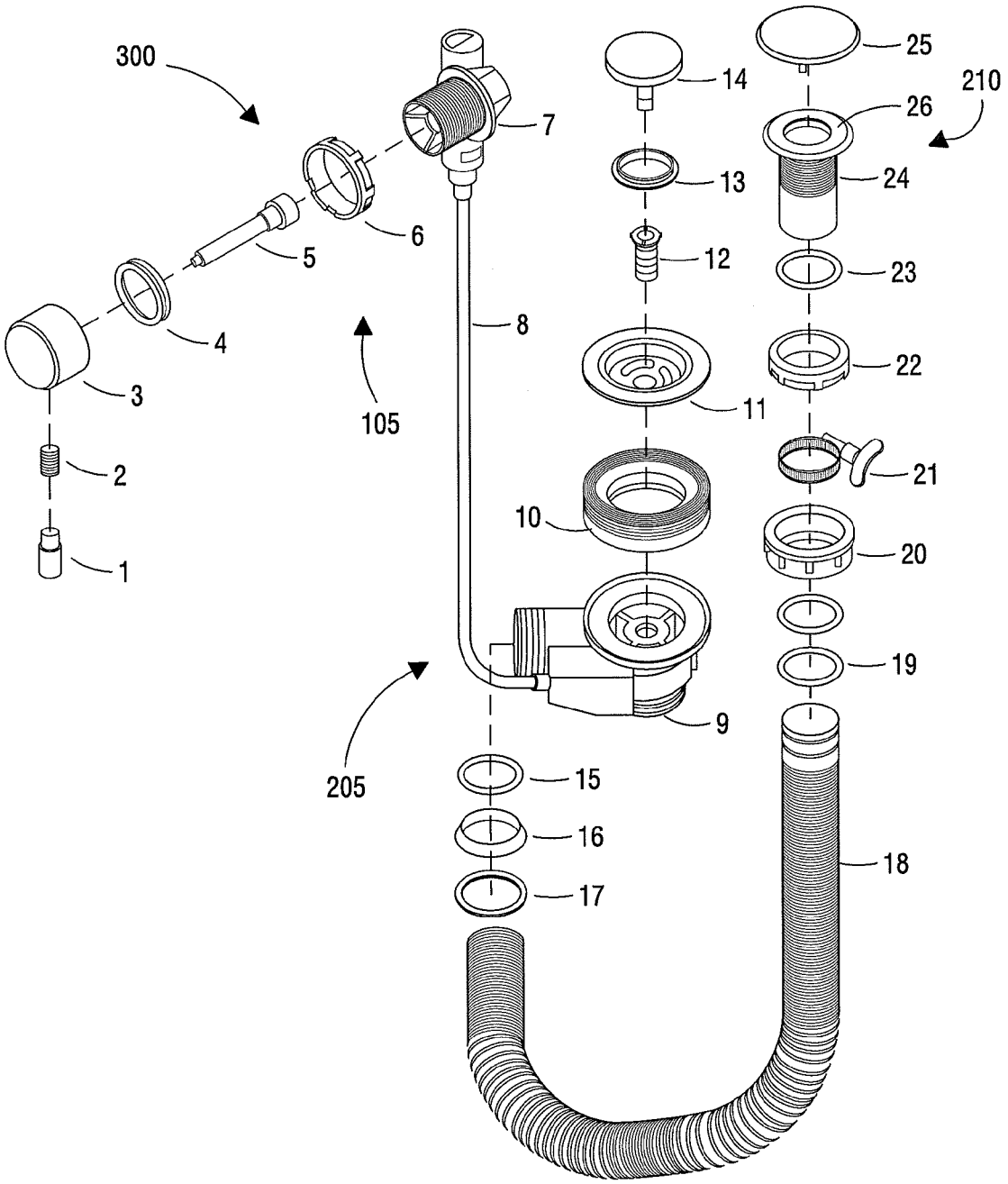
FIG. 3 is a pre-assembly view of an embodiment of a fluid overflow system with an external control member, such as that shown in FIG. 2.

FIG. 3 is a pre-assembly view of a fluid overflow drainage system 300 with an external control member 105, such as that shown in FIG. 2. The external control member 105 can include a knob 1 that is attached to a handle 3 via a screw 2. The external control member 105 can further include a handle base 7 that is attached to the handle 3 via a locking nut 4, handle spindle 5, and setting nut 6. The handle base 7 is mechanically coupled to a drain body 9 via a cable 8, all of which facilitates opening and closing the drain.

The drain body 9 can include a rubber gasket 10 that engages the drainage opening of the basin 115 to prevent leakage of fluid and to channel fluid into the drain body 9. A flange 11 is placed on top of the rubber gasket 10 and both the flange 11 and rubber gasket 10 are secured to the drain body 9 via a hex locking nut 12. A top rubber gasket 13 is placed on top of the flange 11, and a stopper 14 is secured to the drain body 9 via the hex locking nut 12.

The drain body 9 is attached to a flexible tube 18 via a seal o-ring 15, gasket 16, and plastic ring 17. The flexible tube 18 is coupled to the overflow body 24 using an o-ring 19, plastic nut 20, clamp 21, lucking nut 22, and gasket 23. The overflow body 24 is attached to an overflow cover 25 that covers the overflow opening. In this example, the overflow body 24 is designed to be disposed into the overflow opening. The overflow body 24 includes threads along the side walls of the overflow body 24 that can be engaged with a locking nut 22 to secure the overflow body 24 to the basin 115 at the overflow opening. A gasket 23 is located between the top cover 26 of the overflow body 24 and the locking nut 22.

Figure 4:
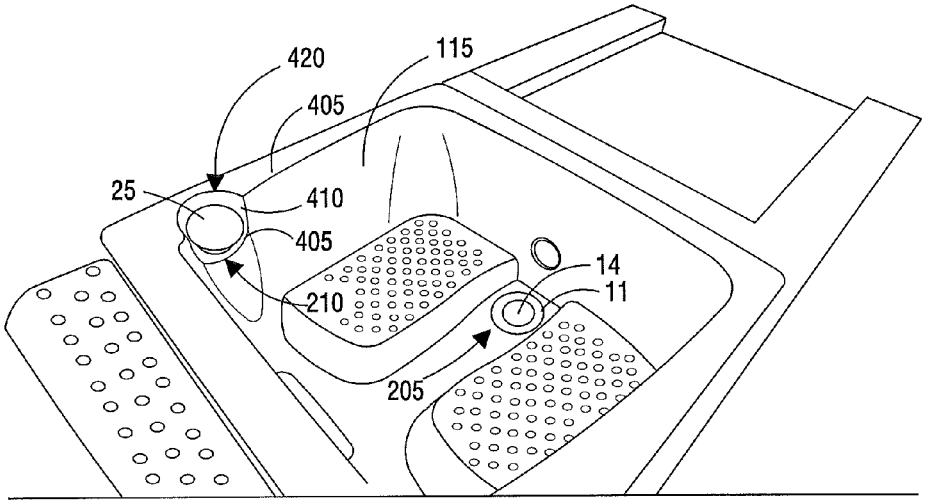
FIG. 4 is a perspective view of an embodiment of a basin having an overflow element, such as that shown in FIG. 2.

FIG. 4 is a perspective view of an embodiment of a basin 115 having an overflow element 210, such as that shown in FIG. 2. An overflow opening of the basin 115 is placed at a recessed section 420 of the basin 115 that is located adjacent to the top of the inner surface of the basin 115 such that water filling in and reaching close to the top of the basin 115 can flow into the overflow opening.

The overflow opening at the recessed section 420 of the basin 115 is substantially horizontal in relation to the top edge of the basin 115. The recessed section 420 of the basin 115 includes a bottom wall 415 and a semi-circular side wall 410 that partially surrounds the bottom wall 415. In this example, the side wall 410 substantially conforms to the shape of the overflow cover 25 of the overflow element 210. The top of the side wall 410 of the recessed section 420 integrates with the top edge of the basin 115. The overflow opening is placed at the bottom wall 415 of the recessed section 420 of the basin 115.

In this example, the overflow opening, recessed section 420 and the overflow element 210 is located at a corner of the basin 115, particularly left front corner of the basin 115. The bottom wall 415 is shaped substantially as a circle and a portion of the bottom wall 415 protrudes outward. A portion of the side wall 410 of the basin 115 is integrated to the bottom wall 415 and also protrudes outward.

Figure 5:
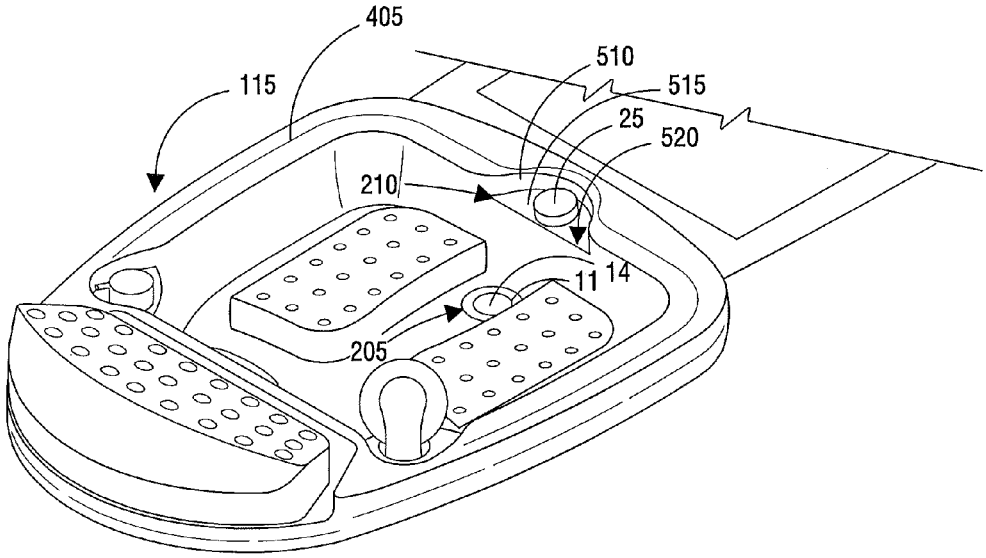
FIG. 5 is a perspective view of another embodiment of a basin having an overflow element, such as that shown in FIG. 2.

FIG. 5 is a perspective view of another embodiment of a basin 115 having an overflow element 210, such as that shown in FIG. 2. In this example, an overflow opening, recessed section 520 and the overflow element 210 is located at a top edge and center of the side wall of the basin 115, particularly center rear side wall of the basin 115.

The recessed section 520 of the basin 115 includes a bottom wall 515 and a semi-circular side wall 510 that partially surrounds the bottom wall 515. Unlike the side wall 410 of the basin 115 in FIG. 4, the side wall 510 of FIG. 5 diverges away from the overflow cover 25 of the overflow element 210 as the side wall 510 of the recessed section 520 integrates to the side wall of the basin 115, and the bottom wall 515 of the recessed section 520 and the side wall of the basin 115 forms a continuous plane. The top of the side wall 510 of the recessed section 420 integrates with the top edge of the basin 115. The overflow opening is placed at the bottom wall 515 of the recessed section 520 of the basin 115.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

Therefore, having thus described the disclosure, at least the following is claimed:

1. A spa apparatus comprising:

a basin having a drainage opening, wherein the drainage opening is located at the lowest point of the basin so that water can be drained;

a basin structure that houses the basin;

a chair that is attached to the basin structure; and a fluid drainage system that includes a drainage element and an external control element, wherein the drainage element is coupled to the drainage opening and the external control element controls the drainage element to open and shut the drainage opening, wherein the external control element is attached to a front wall of the basin structure, wherein the drainage element is fitted with a stopper that is attached to a cable, which is also attached to the external control element, wherein the external control element using the cable controls the movement of the stopper to open and shut the drainage opening to drain fluid inside the basin without inserting a user's hand in the fluid to control the movement of the stopper.

2. The spa apparatus as defined in claim 1, wherein the external control element includes a handle that is coupled to the drainage element via the cable, wherein the handle is configured to open and close the drainage element.

3. The spa apparatus as defined in claim 1, further comprising an overflow opening that is placed at a recessed section of the basin that is located adjacent to the top of the inner surface of the basin such that water filling in and reaching close to the top of the basin can flow into the overflow opening.

4. The spa apparatus as defined in claim 3, wherein the overflow opening at the recessed section of the basin is substantially horizontal in relation to the top edge of the basin.

5. The spa apparatus as defined in claim 3, wherein the recessed section of the basin includes a bottom wall and at least one side wall that partially surrounds the bottom wall, the top of the at least one side wall of the recessed section integrates with the top edge of the basin, wherein the overflow opening is placed at the bottom wall of the recessed section of the basin.

6. The spa apparatus as defined in claim 3, further comprising an overflow element that includes an overflow body attached to the basin, wherein the overflow body engages the overflow opening and facilitates water flowing into the overflow opening.

7. The spa apparatus as defined in claim 6, wherein the overflow element includes an overflow cap that covers an opening of the overflow body.

8. The spa apparatus as defined in claim 6, wherein the overflow element includes a flexible tube that is coupled and extends from the overflow body to the drainage element.

9. A basin apparatus comprising:

a basin having a drainage opening, wherein the drainage opening is located at the lowest point of the basin so that water can be drained;

a basin structure that houses the basin; and a fluid drainage system that includes a drainage element and an external control element, wherein the drainage element is coupled to the drainage opening and the external control element controls the drainage element to open and shut the drainage opening, wherein the external control element is attached to a front wall of the basin structure, wherein the drainage element is fitted with a stopper that is attached to a cable, which is also attached to the external control element, wherein the external control element using the cable controls the movement of the stopper to open and shut the drainage opening to drain fluid inside the basin without inserting a user's hand in the fluid to control the movement of the stopper.

10. The basin apparatus as defined in claim 9, wherein the external control element includes a handle that is coupled to the drainage element via the cable, wherein the handle is configured to open and shut the drainage element.

11. The basin apparatus as defined in claim 9, further comprising an overflow opening that is placed at a recessed section of the basin that is located adjacent to the top of the inner surface of the basin such that water filling in and reaching close to the top of the basin can flow into the overflow opening.

12. The basin apparatus as defined in claim 11, wherein the overflow opening at the recessed section of the basin is substantially horizontal in relation to the top edge of the basin.

13. The basin apparatus as defined in claim 11, wherein the recessed section of the basin includes a bottom wall and at least one side wall that partially surrounds the bottom wall, the top of the at least one side wall of the recessed section integrates with the top edge of the basin, wherein the overflow opening is placed at the bottom wall of the recessed section of the basin.

14. The basin apparatus as defined in claim 11, further comprising an overflow element that includes an overflow body attached to the basin, wherein the overflow body engages the overflow opening and facilitates water flowing into the overflow opening.

15. The basin apparatus as defined in claim 14, wherein the overflow element includes an overflow cap that covers an opening of the overflow body.

16. The basin apparatus as defined in claim 14, wherein the overflow element includes a flexible tube that is coupled and extends from the overflow body to the drainage element.

17. A basin comprising:

a drainage opening that is located at the lowest point of the basin so that water can be drained;

an overflow opening that is placed at the top of the inner surface of the basin such that water filling in and reaching close to the top of the basin can flow into the overflow opening; and a drainage element is coupled to the drainage opening, wherein the drainage element is coupled to the overflow opening via a flexible tube; wherein the drainage element is configured to drain water from both the overflow opening and the drainage opening, wherein the drainage element is coupled to an external control element that controls the drainage element to open and shut the drainage opening, wherein the external control element is attached to a front wall of a basin structure that houses the basin, wherein the drainage element is fitted with a stopper that is attached to a cable, which is also attached to the external control element, wherein the external control element using the cable controls the movement of the stopper to open and shut the drainage opening to drain fluid inside the basin without inserting a user's hand in the fluid to control the movement of the stopper.

18. The basin as defined in claim 17, wherein the overflow opening is located at a recessed section of the basin and is substantially horizontal in relation to the top edge of the basin.

19. The basin as defined in claim 18, wherein the recessed section of the basin includes a bottom wall and at least one side wall that partially surrounds the bottom wall, the top of the at least one side wall of the recessed section integrates with the top edge of the basin, wherein the overflow opening is placed at the bottom wall of the recessed section of the basin.

* * * * *